United States Patent [19]

Clarke

[11] 4,453,327

[45] Jun. 12, 1984

[54] SOLAR DISPLAY KIOSK

[75] Inventor: Ronald A. W. Clarke, London, Canada

[73] Assignee: Animotion Inc., London, Canada

[21] Appl. No.: 349,166

[22] Filed: Feb. 16, 1982

[51] Int. Cl.[3] ..... G09F 13/00

[52] U.S. Cl. ..... 40/562; 40/606; 52/28; 52/38; 52/65; 52/200

[58] Field of Search ..... 52/200, 73, 65, 80, 52/28, 38; 40/502, 503, 504, 506, 507, 559, 560, 561, 562, 563, 606, 607; 350/258, 264; 362/367, 806, 812

[56] References Cited

U.S. PATENT DOCUMENTS

| | | | |
|---|---|---|---|
| 285,625 | 9/1883 | Hyatt | 350/264 |
| 601,577 | 3/1898 | Manning | 40/561 |
| 616,826 | 12/1898 | Daly | 40/502 |
| 838,075 | 12/1906 | Brown | 40/502 |
| 1,045,642 | 11/1912 | Torrey | 40/502 |
| 1,545,009 | 7/1925 | Paine | 40/559 |
| 1,756,849 | 4/1930 | Braastad | 52/28 |
| 1,915,236 | 1/1933 | Messner et al. | 40/502 |
| 2,068,323 | 1/1937 | Harrison | 40/502 |
| 3,105,315 | 10/1963 | Snethen | 40/502 |
| 3,345,766 | 10/1967 | Timlin | 40/502 |

*Primary Examiner*—Alfred C. Perham
*Attorney, Agent, or Firm*—Mitches & Co.

[57] ABSTRACT

A solar display kiosk particularly to a display kiosk that during day time conditions is illuminated by the sun. It provides, in its preferred embodiment, a closed cylindrical member placed in the vertical position with an open or a closed but light transmissive upper end, which acts as a receiver for solar or ambient light. A circumferential band at the top of the kiosk acts a shading member to place regions immediately beneath such band into shade either totally or in part (umbra and penumbra). Translucent display materials are mounted in the walls of the cylinder in the zones of umbra or penumbra. To the viewer they appear to be highly illuminated, the illumination coming from the solar light entering into the center of the cylinder.

9 Claims, 4 Drawing Figures

SOLAR DISPLAY KIOSK

This invention relates to a solar display kiosk.

Outdoor billboard advertising is common in the western world and various techniques are used in order to encourage viewers to view and to absorb billboard advertising.

Some of the more effective mechanisms, to increase viewer perception of outdoor advertising include, colour pictures rather than black and white; their illumination; and, their motion.

I have conceived of a kiosk structure formed as a closed conic, preferably a cylinder vertically positioned on the ground and structured to display about a portion of its perimeter, as a circumferential band, advertising material which is illuminated from within the kiosk. The advertising material is translucent so as to allow the light resident within the cylinder to pass through the advertising material and hence to illuminate it. In order to seal the open upper end of the cylinder against the elements, a transparent cover is provided, preferably in the form of a dome or cupola. Thus, ambient solar light enters into the centre of the cylinder and is reflected to pass through the translucent advertising material. The advertising material appears to a viewer to be illuminated.

When the advertising material is made from photographic transparency material, which has the characteristic of being highly saturated in colour, a dynamically pleasing billboard is achieved.

Those skilled in the art will know that photographic transparency materials offer higher colour saturation and colour latitudes than those achievable by any printed form presently known in the art.

I have also conceived that variations in the embodiments include means to cause the advertising material to slowly revolve. Hence, movement is imparted to the advertising material for greater attraction to the viewer.

The invention therefore contemplates a solar display kiosk comprising;

(a) a closed conic having an upper and a lower end, spacely disposed by a circumscribing wall that defines a plenum;

(b) the upper end defining a first light transmissive region whereby ambient light is adapted to pass through said first region into the plenum;

(c) the conic wall defining a second light transmissive region for conveying the ambient light within the plenum through the wall to the space immediately exterior to said plenum and the conic;

(d) means peripheral to said second light transmissive region for securing in close proximity thereto, indica;

(e) means within said plenum, for reflecting ambient light entering therein, via the first light transmissive region, through said second light transmissive region so as to illuminate said indica by means of back lighting;

The invention will now be described by way of example and reference to the accompanying drawings in which.

Figure 1:
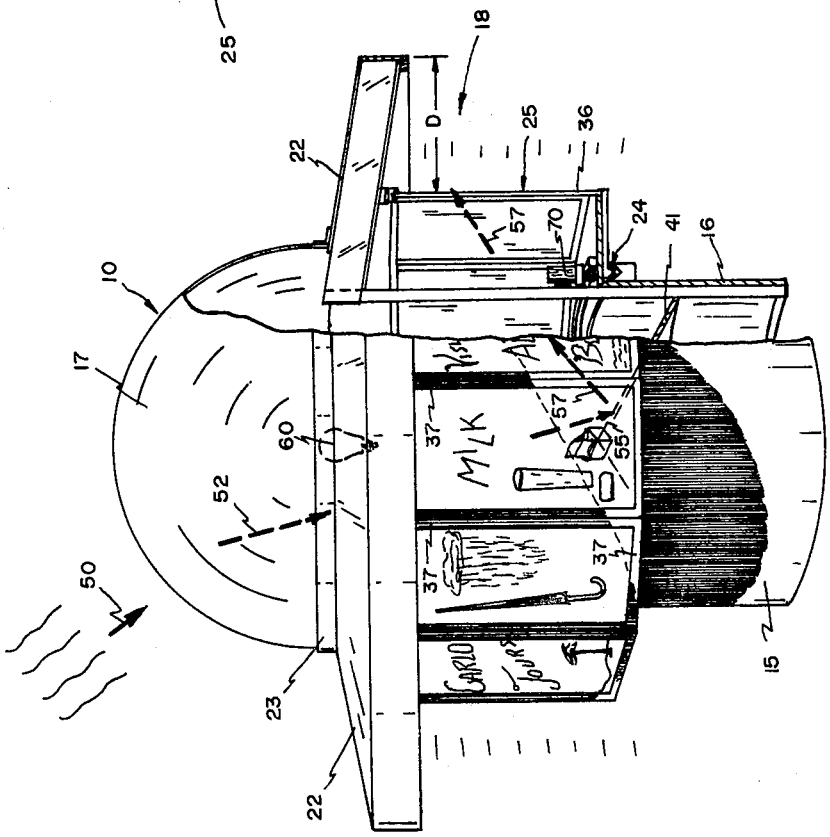
FIG. 1 is a perspective, partially in section, of a kiosk structure according to the invention.

Referring to FIG. 1, a kiosk structure 10 consists of an upright cylinderical housing 15 positioned so its central axis is in the vertical and hence disposes an open upper end. A transparent or translucent surface whose area is substantially the same or preferably greater than that of the open end covers, the open end preferably as cupola or dome 17 mounted over the open end to shield the interior of the cylindrical housing 15 from the elements.

Immediately beneath the dome and juxaposed to it is a frusto-conical shaped roof 22. The cupola 17 is attached to the roof by a welt 23. Immediately beneath the roof and circumferentially mounted in the walls of the housing 15 is a display band or collar 25.

Preferably, all of the display band 25 is in the umbra of the roof 22, but it is possible that the lower portions of the display band be in the penumbra. I perfer that the display band 25 in the umbra and shaped as a polygon.

In the figures the display band is a twelve sided polygon. Each side 30 thereof permits the fastening to it of display material such as a display, sheet, panel member or a poster 36. Thus, a plurality of posters are placed in juxaposition to compose the twelve sided polygonal display band 25.

In order to hold the poster 36 within the band 25, a rigid border or surround 37 is provided about each poster. The poster 36 is attached to surround 37 by any convenient means for instance by conventional fasteners. Alternatively, when the poster itself is transulcent photographic material it may be applied to the support sheet 38 which is clear or translucent. The support sheet 38 front of the photographic material 36. I show, in the Figures, an embodiment in which the poster 36 is adhered to the frontals surface of the support sheet 38 but it really does not matter. Each support sheet 38 is then attached to the circumferential border 37 by fasteners, not clearly shown. Preferably therefore, the sheet 38 maybe clear or translucent glass or plexi-glass or other rigid light transmitting sheet material.

Just beneath the band 25, the interior of the cylinder 15 is formed into a reflective conical member 41. The member 41 is positioned so as its apex is upward of its circumferential base.

During day light ambient light, generally shown as rays 50 travel from space to strike the cupla dome 17 and pass through the dome to enter into the interior of the cylinder 15 as 52. The majority of rays will strike the surface of the reflective member 41 at the strike zone as 55. The reflective conical sheet 41 causes the ray at 55 to be reflected as ray 57 along a straight path and to strike the inside surface of the display sheet 36. The rays pass through the display sheet and appear to illuminate it. A viewer, not shown, will perceive the display sheet 36 illuminated.

The truncated conical roof 22 is slightly inclined in order to permit water drainage, as when it rains. The roof extends a distance D beyond the display panel (band 25) so as to place both upper and lower regions of each display panel 36 either in a zone of umbra or penubra with the roof. As a result, the intensity of light, immediately in front of the display panels 36, is maintained lower in light intensity than the intensity of light cylinder 15. In view of this differential in light intensity, on opposite sides of the display panel, the display panel 36 appears or is perceived to be illuminated from the behind by a strong light source.

It will be apparent; therefore, to those skilled in the art that such a kiosk structure eliminates the need of artificial light during daytime while giving the viewer the illusion of a lighted display. When photographic colour transparency materials are used as the poster or display panels 36, highly satisfying displays are created.

In an alternative variation of this embodiment, and in order to provide illuminated panels 36 nocturnally, a source of synthetic light, for instance a light bulb 60 maybe provided within the cylinder 15. The light source 60 can be placed beneath the reflective member 41 when the reflective member 41 is made out of transparent or translucent material and when the number 41 is structured within an appropriate apex angle. With such configuration the light source 60 will create light to strike the under surface of the inclined conical member 41 at almost normal; and, hence the member 41 passes all the light through it to strike the rear of the display panel 36 in a fashion. similar to that described in relation to the ambient solar light condition. The panels 36 appear illuminated. When illuminated by artificial light in such a fashion, the dome 17 also glows and adds to the rapture of the view.

If the refractive index of the material 41 is appropriately selected and the apex angle also similarly selected, during day light, the ambient solar light rays 52 striking the surface 41 at 55 will be at an angle in excess of the angle of the reflection; hence, virtually, all of the that point 55 and hence will transverse along path 57 and illuminate the panel 36. Enhanced day-light illumination is thus achieved.

Other convenient locations for the source of artificial light are possible for example about the inner perimeter of the welt 23.

Figure 4:
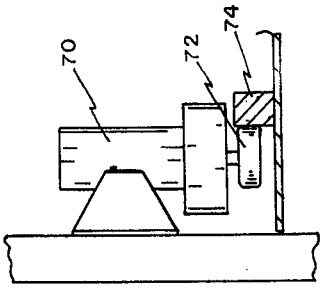
FIG. 4 is an exploded elevational view of a segment of FIG. 1 illustrating a motor for rotating the kiosk.
Figure 2:
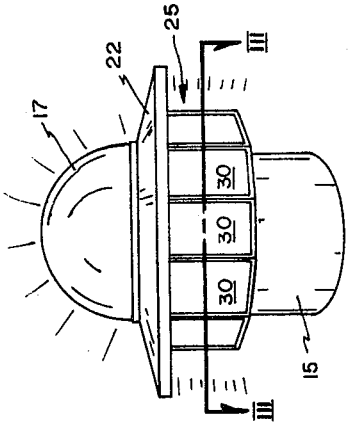
FIG. 2 is a further perspective for explanation.
Figure 3:
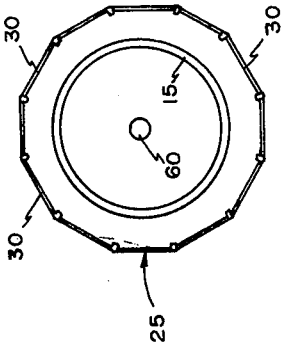
FIG. 3 is a section along lines III—III of FIG. 2, illustrating nocturnal illumination.

In a further variation of the invention, the panels 36, roof 22, and dome 17 may revolve about the vertical longitudinal axis of the cylindrical housing 15. This is achieved by providing a circumferential channel or race 24 immediately below the display band 25 and constructing the solar display kiosk 10 as two separate structures; a lower cylindrical base 16 around which the near upper end thereof is a circumferentially mounted channel 74 (see FIG. 4). There is a second piece; an upper unitary closed cylindrical piece 18, of larger diameter than the base 16, and consisting of the dome 17, roof 22, display band 25, and a corresponding race for the channel. The channel and mold constitute reference 24. Prime mover, 70, drive the upper closed cylindrical piece 18 to revolve about in the race and channel 24 and hence imparts revolving motion to the illuminated posters.

The embodiments of the invention in which an exclusive property or privilege is claimed are defined as follows:

1. A solar display kiosk comprising;

(a) a closed conic having an upper and a lower end, spacely disposed by a circumscribing wall that defines a plenum;

(b) the upper end defining a first light transmissive region carrying thereon a pellucid ambient light capture area that is substantially equal to or greater than that of said upper end, whereby ambient light is adapted to pass through said first region into the plenum;

(c) the conic wall defining a second light transmissive region for conveying the ambient light within the plenum through the wall to the space immediately exterior to said plenum and the conic;

(d) means peripheral to said second light transmissive region for securing in close proximity thereto, indica;

(e) means within said plenum, for conveying ambient light entering therein, via the first said light transmissive region, through said second light transmissive region so as to illuminate said indica by means of back lighting; and, (f) a light obscuring canopy projecting above and extending over said second light transmissive region so as to project shade onto and partially obscure said second region from direct illumination by ambient light.

2. The kiosk as claimed in claim 1 wherein the conic is an upright cylinder.

3. The kiosk as claimed in claim 1 wherein the second light transmissive region consists of a plurality of spacely disposed regions mounted in the wall to circumscribe said Kiosk.

4. The kiosk as claimed in claim 1, 2 or 3 including artificial light generating means within said plenum for generating an intensity of lumens greater than the ambient light whereby the light transmissive regions of the kiosk appear illuminated by back lighting.

5. The kiosk as claimed in claim 1, 2 or 3 and hence place said second region substantially in penumbra wherein the canopy depends from the upper end and hence places said second region substantially in penumbra.

6. The kiosk as claimed in claim 1, 2 or 3 wherein the upper end is a light transmissive cupola.

7. The kiosk as claimed in claim 1, 2 or 3 having an axis of conic revolution and means for rotating the kiosk about said axis at a speed of revolution not exceeding three revolutions per minute.

8. The kiosk as claimed in claim 1, 2 or 3 having an axis of conic revolution and means for rotating the kiosk about said axis at a speed of revolution not exceeding one revolution per hour.

9. The kiosk as claimed in claim 1, 2 or 3 wherein the indicia are mounted on sheets of translucent display material.

* * * * *